US008545250B2

(12) United States Patent
Ju et al.

(10) Patent No.: US 8,545,250 B2
(45) Date of Patent: Oct. 1, 2013

(54) ELECTRICAL CONNECTOR FOR CONNECTING CHIP MODULE TO CIRCUIT BOARD

(75) Inventors: Ted Ju, Keelung (TW); Shang Ju Tsai, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/435,048

(22) Filed: Mar. 30, 2012

(65) Prior Publication Data

US 2012/0252239 A1 Oct. 4, 2012

Related U.S. Application Data

(60) Provisional application No. 61/470,669, filed on Apr. 1, 2011, provisional application No. 61/473,607, filed on Apr. 8, 2011.

(30) Foreign Application Priority Data

Jan. 19, 2012 (CN) ..... 2012 2 0037729 U

(51) Int. Cl.
*H01R 13/625* (2006.01)

(52) U.S. Cl.
USPC ..... 439/342; 439/265

(58) Field of Classification Search
USPC ..... 439/70–73, 259, 264, 265, 330, 331, 439/342
See application file for complete search history.

(56) References Cited

U.S. PATENT DOCUMENTS

| | | | | |
|---|---|---|---|---|
| 5,415,559 | A * | 5/1995 | Ichimura | 439/259 |
| 5,611,705 | A * | 3/1997 | Pfaff | 439/266 |
| 6,540,538 | B2 * | 4/2003 | Nakano et al. | 439/266 |
| 6,776,643 | B2 * | 8/2004 | Nakano | 439/342 |
| 6,866,531 | B2 * | 3/2005 | Hachuda | 439/331 |
| 7,297,010 | B2 * | 11/2007 | Tsai | 439/331 |
| 8,118,603 | B2 * | 2/2012 | Ho | 439/70 |
| 8,215,998 | B1 * | 7/2012 | Ju et al. | 439/660 |

* cited by examiner

*Primary Examiner* — Thanh Tam Le
(74) *Attorney, Agent, or Firm* — Morris Manning & Martin LLP; Tim Tingkang Xia, Esq.

(57) ABSTRACT

An electrical connector includes a body having a plurality of receiving slots, a plurality of terminals respectively accommodated in the receiving slots, each terminal having a stopping portion, and a cover, slideably covered on the body, and having a plurality of pressed surfaces respectively corresponding to the stopping portions. When the cover slides along a first direction relative to the body, the stopping portion limits upward displacement of the pressed surface, so as to limit upward warping of the cover, thereby ensuring good contact between the terminal and a mating element.

12 Claims, 10 Drawing Sheets

ELECTRICAL CONNECTOR FOR CONNECTING CHIP MODULE TO CIRCUIT BOARD

CROSS-REFERENCE TO RELATED APPLICATIONS

This non-provisional application claims priority to and the benefit of, pursuant to 35 U.S.C. §119(e), U.S. provisional patent application Ser. No. 61/470,669, filed Apr. 1, 2011, entitled "ELECTRICAL CONNECTOR ASSEMBLY", by Ted Ju and Wen Chang Chang, and 61/473,607, filed Apr. 8, 2011, entitled "ELECTRICAL CONNECTOR ASSEMBLY", by Ted Ju and Shang Ju Tsai, the content of which is incorporated herein in its entirety by reference. This application also claims priority to and benefit of, pursuant to 35 U.S.C. §119(a), Chinese patent application Serial No. 201220037729.2, filed Jan. 19, 2012, entitled "Electrical Connector," by Ted Ju and Shang Ju Tsai, which is incorporated herein by reference in its entirety.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for electrically connecting a chip module to a circuit board.

BACKGROUND OF THE INVENTION

An existing electrical connector includes a body having a plurality of receiving slots formed through thereof, a plurality of terminals received in the receiving slots, a cover located on the body, and a driving member received in the cover and the body. The driving member is used for driving the cover to slide relative to the body. In the connector of such a structure, when the cover slides relative to the body, the cover is easily excessively warped upward and thus cannot complete the task, or even the structure of the cover is easily broken due to excessive upward warping, resulting in that the whole electrical connector cannot be used any more.

Therefore, a heretofore unaddressed need exists in the art to address the aforementioned deficiencies and inadequacies.

SUMMARY OF THE INVENTION

In one aspect, the present invention is directed to an electrical connector for limiting upward warping of the cover.

In one embodiment, an electrical connector according to the present invention includes a body having a plurality of receiving slots, a plurality of terminals respectively accommodated in the receiving slots, and a cover slideably covered on the body. Each terminal has a stopping portion, and the cover has a plurality of pressed surfaces respectively corresponding to the stopping portions. When the cover slides along a first direction relative to the body, the stopping portion limits upward displacement of the pressed surface.

Further, the cover has a plurality of pushing surfaces. When the cover slides along the first direction, the pushing surface pushes the terminal to shift along the first direction, and the terminal produces an upward force on the pushing surface.

Further, the cover has a plurality of connecting portions, and the pressed surface and the pushing surface are two different surfaces of the connecting portion.

Further, the stopping portion is located right above the pressed surface.

Further, when the cover slides along the first direction, the pressed surface pushes the stopping portion to shift along the first direction, and the stopping portion produces a downward force on the pressed surface.

Further, the pressed surface is arc-shaped, and when the cover slides along the first direction, a contact point between the stopping portion and the pressed surface is located above a center of circle corresponding to the pressed surface.

Further, the stopping portion is also arc-shaped, and a center of circle corresponding to the stopping portion is located above the center of circle corresponding to the pressed surface.

In another embodiment according to the present invention, an electrical connector for electrically connecting a mating element includes a body having a plurality of receiving slots, a plurality of terminals respectively received in the receiving slots and a cover slideably covered on the body. Each terminal has a stopping portion and a contact portion. The cover has a plurality of pressed surfaces respectively corresponding to the stopping portions. When the cover is at a starting position, the contact portion is higher than an upper surface of the cover. The cover first slides along a first direction relative to the body, during which process the cover pushes the terminal so that the contact portion shifts downward, and the stopping portion limits upward displacement of the pressed surface. Then the cover slides along a direction opposite to the first direction, so that the contact portion shifts upward and urges against the mating element.

Further, when the cover slides on an upper surface of the body along the first direction to an endpoint, the contact portion shifts downward to be below the upper surface of the cover. When the cover slides along the direction opposite to the first direction, the contact portion protrudes out of the upper surface of the cover.

Further, when the cover slides along the direction opposite to the first direction, the terminal is not pushed by an external force, and only springs upward due to elasticity thereof, so that the contact portion shifts upward to push the mating element to a predetermined height.

Further, the cover has a plurality of pushing surfaces. When the cover slides on an upper surface of the body along the first direction, the pushing surface pushes the terminal to shift downward, and the terminal produces an upward force on the pushing surface.

Further, the cover has a plurality of connecting portions, and the pressed surface and the pushing surface are two different surfaces of the connecting portion.

Further, the stopping portion is located right above the pressed surface.

Further, when the cover slides along the first direction, the pressed surface pushes the stopping portion to shift toward the first direction, and the stopping portion produces a downward force on the pressed surface.

Further, the pressed surface is arc-shaped. When the cover slides along the first direction, a contact point between the stopping portion and the pressed surface is located above a center of circle corresponding to the pressed surface.

Further, the stopping portion is also arc-shaped, and a center of circle corresponding to the stopping portion is located above the center of circle corresponding to the pressed surface.

As compared with the related art, in the present invention, among other things, when the cover slides along the first direction, as the stopping portion of the terminal limits upward displacement of the pressed surface of the cover, upward warping of the cover is limited, thereby ensuring the performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
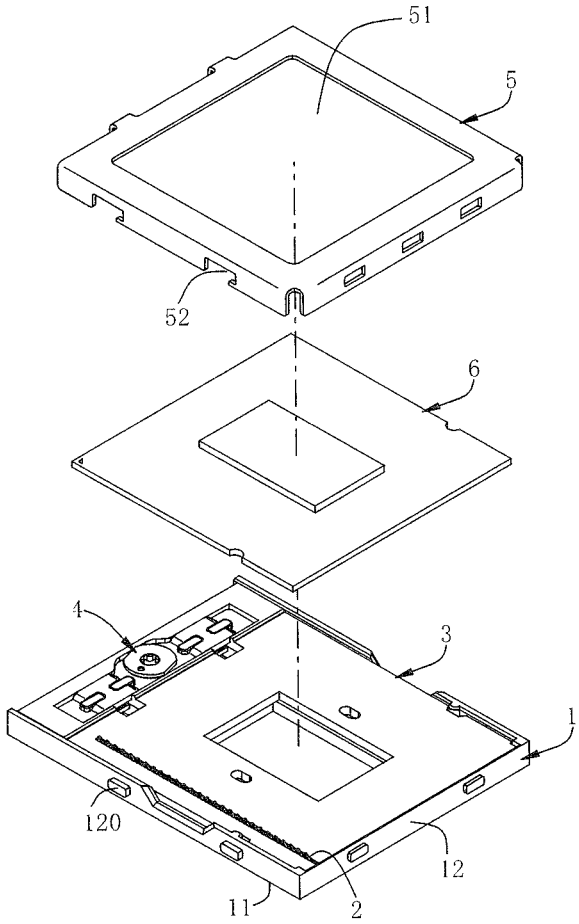
FIG. 1 is a schematic three-dimensional exploded view of a first embodiment of an electrical connector of the present invention and a chip module.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Referring to FIGS. 1-5, an electrical connector according to a first embodiment of the present invention is a Translational Land Grid Array (TLGA) electrical connector, which is used for electrically connecting a chip module 6 to a circuit board (not shown), and includes a body 1, a plurality of terminals 2 received in the body 1, and a cover 3 covered on the body 1. The cover 3 is capable of sliding along a first direction and a direction opposite to the first direction, that is, a second direction, relative to the body 1. When the cover 3 slides along the first direction relative to the body 1, the terminal 2 is pushed to shift downward, and when the cover 3 slides along the second direction relative to the body 1, the terminal 2 shifts upward. The electrical connector further includes a driving member 4 and a pressing frame 5, and the chip module 6 is located between the cover 3 and the pressing frame 5.

Figure 2:
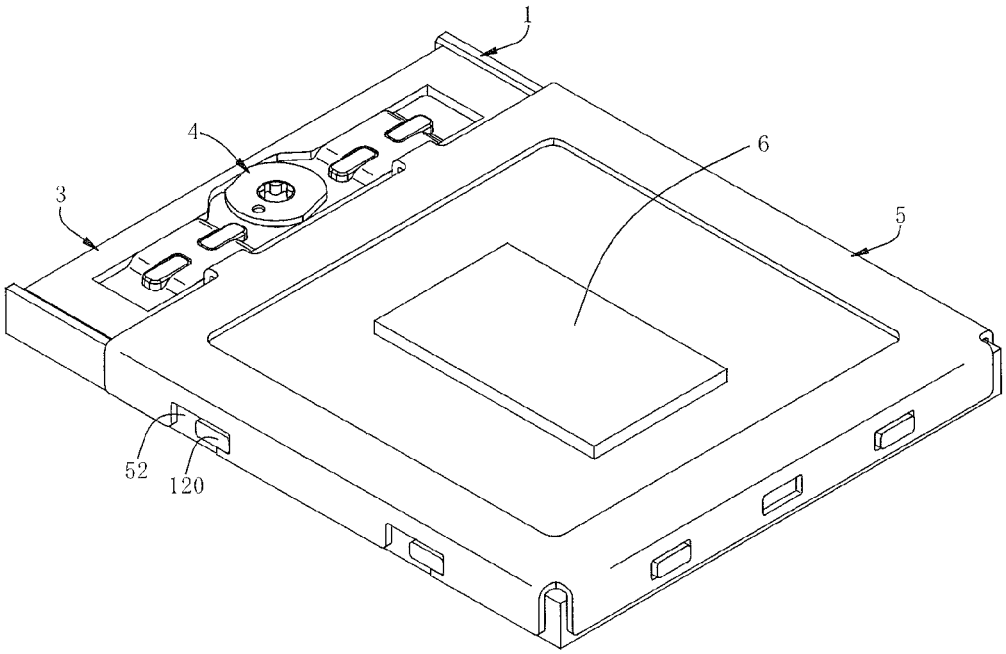
FIG. 2 is a schematic three-dimensional assembled view of the first embodiment of the electrical connector and the chip module shown in FIG. 1.
Figure 3:
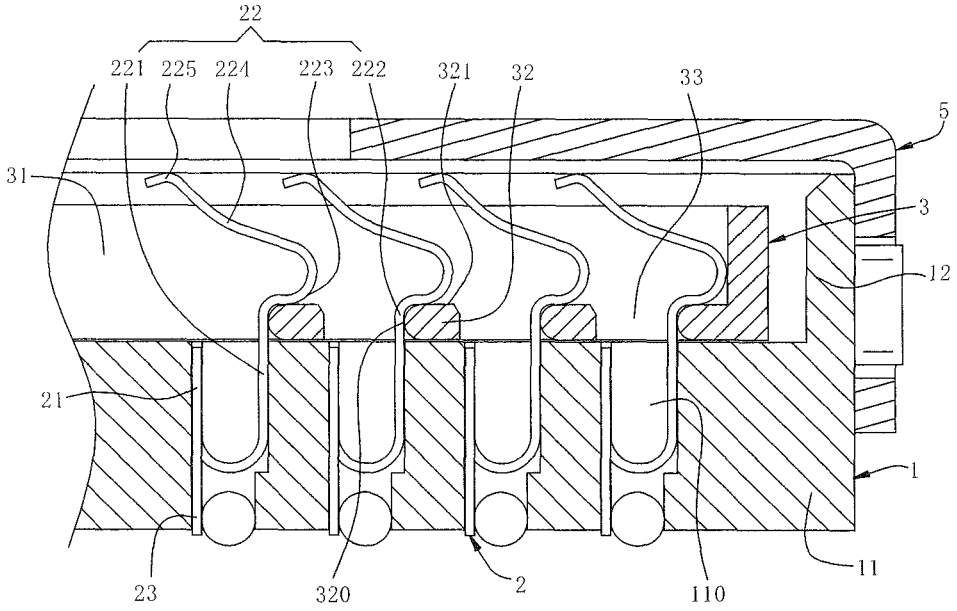
FIG. 3 is a schematic sectional view of the first embodiment of the electrical connector of the present invention when a cover is at a starting position.

Referring to FIGS. 1-3, the body 1 is made of plastic, and includes a bottom wall 11 and side walls 12 extending upward from side edges of the bottom wall 11. The bottom wall 11 has a plurality of receiving slots 110 formed through an upper surface and a bottom surface of the bottom wall 11. The receiving slots 110 are arranged in a matrix. The side wall 12 has a plurality of protruding blocks 120.

Referring to FIG. 3, the terminal 2 is formed by stamping and bending a metal plate, and has an upright base 21 fixed in the receiving slot 110, a soldering portion 23 vertically extending downward from the base 21 and for being soldered to the circuit board, and an arm portion 22 extending upward from the base 21. The arm portion 22 includes a bent arm 221 received in the receiving slot 110, a pushed portion 222 vertically extending upward from the bent arm 221 (alternatively, in other embodiments, the pushed portion 222 may also be arc-shaped or of other shapes), a stopping portion 223 bent rightward and extending from the pushed portion 222, a connecting portion 224 obliquely extending upward from the stopping portion 223, and a contact portion 225 extending upward from the connecting portion 224 and for contacting the chip module 6 upward.

Referring to FIGS. 1-3, the cover 3 is made of plastic, and has a plurality of grooves 31 formed through an upper surface and a bottom surface of the cover 3, where each groove 31 is corresponding to one row of the receiving slots 110. The groove 31 has a plurality of extending portions 32 protruding at an interval and respectively located at right sides of the corresponding pushed portions 222. The extending portion 32 extends to the bottom surface of the cover 3 but does not extend to the upper surface of the cover 3. The extending portion 32 has a pushing surface 320 at a left side thereof, which is used for pushing the pushed portion 222. An upper surface of the extending portion 32 has a pressed surface 321 (in this embodiment, the pressed surface 321 is disposed on the extending portion 32 for the purpose of integrally forming the pressed surface 321 and the pushing surface 320 to facilitate processing, and alternatively, the pressed surface 321 also may not be disposed on the extending portion 32, that is, the pressed surface 321 and the pushing surface 320 may not be integrally formed), which is located right below the stopping portion 223 of the terminal 2 (alternatively, the pressed surface 321 also may not be located right below the stopping portion 223 but the stopping portion 223 is at least partially located in a path of upward displacement of the pressed surface 321, and in contrast, when the pressed surface 321 is located right below the stopping portion 223, the effect of limiting upward displacement of the pressed surface 321 by the stopping portion 223 is better). The groove 31 has a through hole 33 disposed between the two neighboring extending portions 32, and the two neighboring through holes 33 are communicated above the extending portion 32 to the upper surface of the cover 3. The through hole 33 is used for receiving the arm portion 22 of the terminal 2, and specifically, when the cover 3 is at a starting position, the pushed portion 222, the stopping portion 223 and the connecting portion 224 are all received in the through hole 33, and the contact portion 225 protrudes out of the upper surface of the cover 3.

Referring to FIG. 1, the driving member 4 passes through the cover 3 and the body 1, and is used for driving the cover 3 to slide along the first direction and the second direction relative to the body 1. The first direction is oriented horizontally leftward as indicated by a thick arrow shown in FIG. 4, and the second direction is oriented horizontally rightward as indicated by a thick arrow shown in FIG. 5.

Referring to FIG. 1, the pressing frame 5 is formed by stamping a metal plate, and is used for pressing the chip module 6. An opening 51 having a size smaller than that of the chip module 6 is formed in an upper surface of the pressing frame 5. A plurality of clamping slots 52 are disposed at side edges of the pressing frame 5, and are respectively fitted to the protruding blocks 120 of the body 1, so as to fix the pressing frame 5.

In order to mount the chip module 6 to the electrical connector, the following steps are required.

Figure 4:
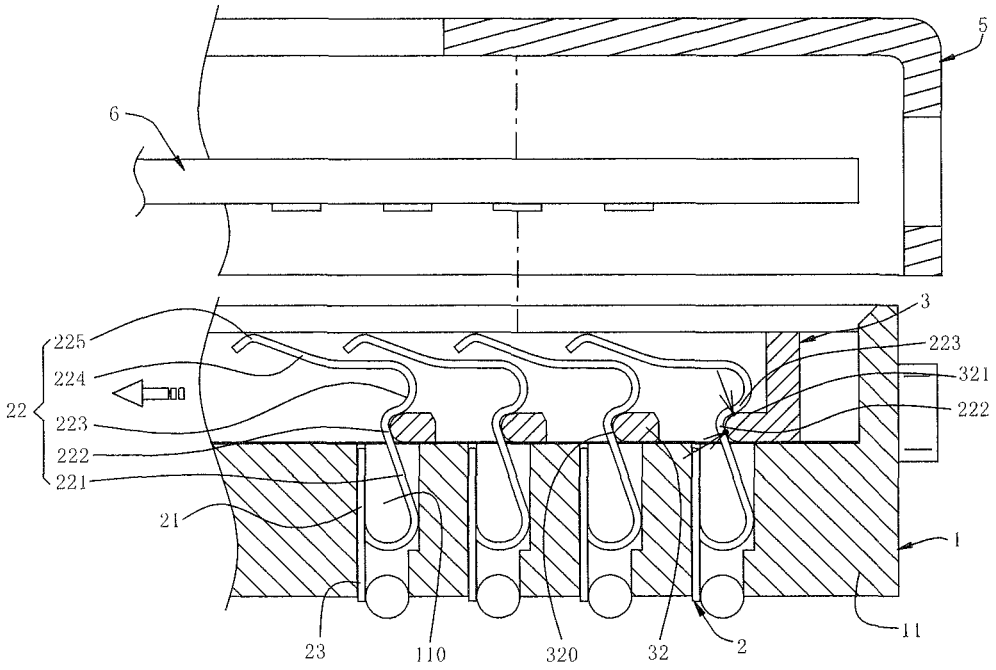
FIG. 4 is a schematic sectional view of the first embodiment of the electrical connector of the present invention when the cover slides along a first direction to an endpoint.

First, the driving member 4 is rotated to drive the cover 3 to slide along the first direction. The pushing surface 320 of the extending portion 32 pushes the pushed portion 222, so that the arm portion 22 deflects leftward and downward by taking a position where the arm portion 22 and the base 21 are connected as a fulcrum. Accordingly, the pushed portion 222 is inclined toward the first direction, and a contact point between the pushed portion 222 and the pushing surface 320 is located below a center of circle corresponding to the pushing surface 320. In this way, the pushing surface 320 produces a downward force on the pushed portion 222, and the pushed portion 222 produces an upward counterforce on the pushing surface 320 (alternatively, the present invention is not limited to the arc-shaped pushing surface 320, and in other embodiments, the pushing surface 320 may also be a chamfer or of other shapes, as long as the pushing surface 320 produces a downward force on the pushed portion 222), so that the cover 3 tends to move upward. However, at this time, the stopping portion 223 of the terminal 2 presses against the pressed surface 321 of the extending portion 32 downward, that is, the stopping portion 223 produces a downward force on the pressed surface 321, which can limit upward displacement of the pressed surface 321, thereby limiting upward warping of the cover 3. After the cover 3 slides along the first direction to an endpoint, the contact portion 225 shifts downward to be below the upper surface of the cover 3 (alternatively, in other embodiments, the contact portion 225 may slightly protrude out of the upper surface of the cover 3), that is, the contact portion 225 is received in the through hole 33, and the final state is shown in FIG. 4.

Then, the chip module 6 is placed on the upper surface of the cover 3, and the pressing frame 5 is fixed to the body 1. At this time, a clearance is formed between the pressing frame 5 and the chip module 6.

Figure 5:
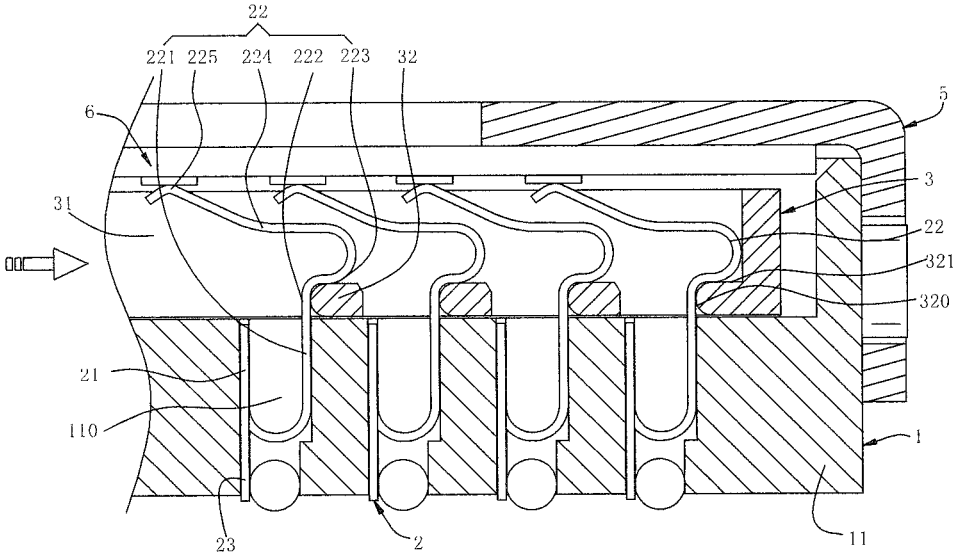
FIG. 5 is a schematic sectional view of the first embodiment of the electrical connector of the present invention when the cover slides along a direction opposite to the first direction to the endpoint.

Finally, the driving member 4 is rotated reversely to drive the cover 3 to slide along the second direction. In this process, the force produced by the extending portion 32 of the cover 3 on the pushed portion 222 of the terminal 2 gradually decreases or even disappears, and accordingly the arm portion 22 springs upward due to elasticity thereof, so that the contact portion 225 moves upward. Therefore, the contact portion 225 produces an upward force on the chip module 6, so that the chip module 6 moves upward by a certain distance to urge against the pressing frame 5. In this way, the contact portion 225 protrudes out of the upper surface of the cover 3 and urges against the chip module 6, thereby achieving good contact between the terminal 2 and the chip module 6, and the final state is shown in FIG. 5.

Figure 6:
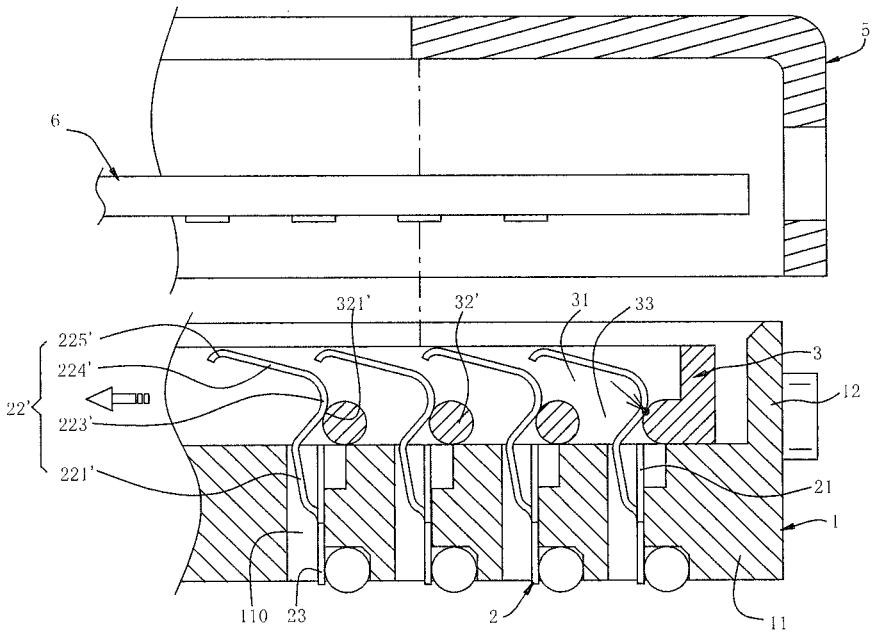
FIG. 6 is a schematic sectional view of a second embodiment of the electrical connector of the present invention when the cover slides along the first direction to the endpoint.
Figure 7:
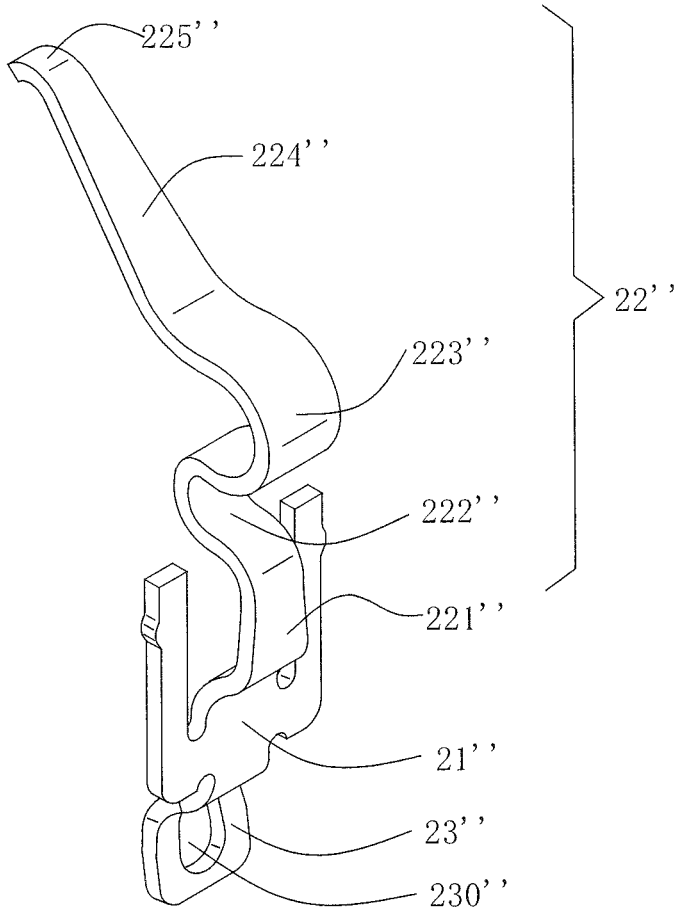
FIG. 7 is a schematic three-dimensional view of a terminal of a third embodiment of the electrical connector of the present invention.
Figure 8:
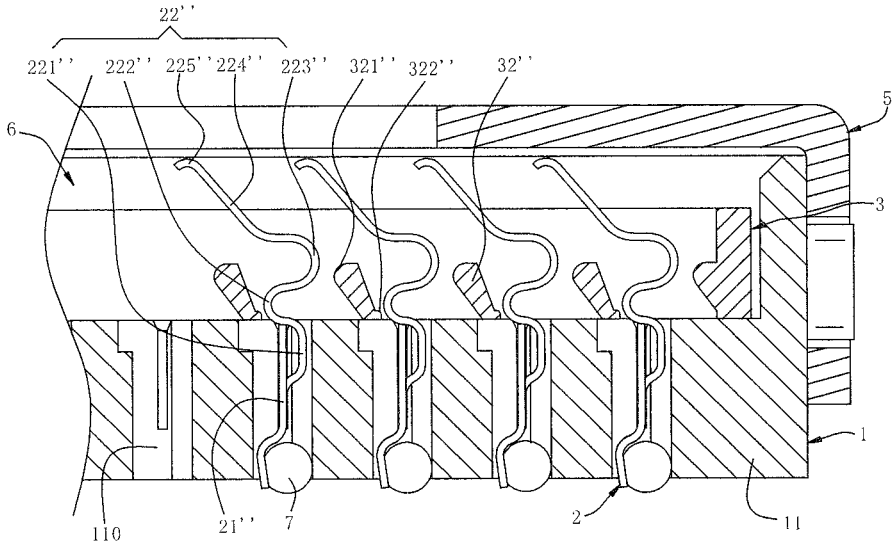
FIG. 8 is a schematic sectional view of the third embodiment of the electrical connector of the present invention when the cover is at the starting position.

Referring now to FIG. 6, an electrical connector according to a second embodiment of the present invention is provided. The second embodiment is mainly different from the first embodiment in that, in the second embodiment, the arm portion 22' of the terminal 2 includes a bent arm 221', an arc-shaped stopping portion 223' connected to the bent arm 221', a connecting portion 224' obliquely extending upward from the stopping portion 223', and a contact portion 225' extending upward from the connecting portion 224' and for contacting the chip module 6. A pressed surface 321' is formed at a position where the extending portion 32' of the cover 3' contacts the stopping portion 223' (in this embodiment, the pressed surface 321' also serves as a pushing surface). The extending portion 32' has a circular cross section, and a center of circle corresponding to the extending portion 32' is located below a center of circle corresponding to the stopping portion 223' of the terminal 2, so that it can be ensured that when the cover 3 slides along the first direction, the force produced by the pressed surface 321' on the stopping portion 223' of the terminal 2 is always upward, and the counterforce produced by the stopping portion 223' on the pressed surface 321' is always downward, thereby limiting upward warping of the cover 3. In this embodiment, the circular cross section of the extending portion 32' is for the purpose of facilitating processing an arc-shaped surface. Alternatively, in other embodiments, the extending portion 32' may also be of other shapes, as long as it can be ensured that the pressed surface 321' is arc-shaped and the center of circle corresponding to the stopping portion 223' is located above the center of circle corresponding to the pressed surface 321'.

FIGS. 7-10 show a third embodiment of the electrical connector of the present invention, which is mainly different from the first embodiment in that, in the third embodiment, the terminal 2 includes a base 21" fixed in the receiving slot 110 and an arm portion 22" extending upward from the base 21", the arm portion 22" includes a bent arm 221", an arc-shaped second stopping portion 222" connected to the bent arm 221", an arc-shaped first stopping portion 223" connected to the second stopping portion 222", a connecting portion 224" extending toward the top left from the first stopping portion 223", and a contact portion 225" extending upward from the connecting portion 224", and the first stopping portion 223" and the second stopping portion 222" form an S shape. The base 21" is bent downward and extends to form a soldering portion 23", which is used for being soldered to the circuit board. The soldering portion 23" has a retaining hole 230" for retaining a solder ball 7. The extending portion 32" of the cover 3 has an arc-shaped first pressed surface 321" at a top left corner thereof, the extending portion 32" has an arc-shaped second pressed surface 322" at a bottom right corner thereof. A center of circle corresponding to the first pressed surface 321" is located below a center of circle corresponding to the first stopping portion 223" at the left side thereof. The second pressed surface 322" is located below a center of circle corresponding to the second stopping portion 222" at the right side thereof. In this embodiment, except for the leftmost extending portion 32" having the second pressed surface 322" only and the rightmost extending portion 32" having the first pressed surface 321" only, all other extending portions 32" in the middle have the first pressed surface 321" and the second pressed surface 322".

Figure 9:
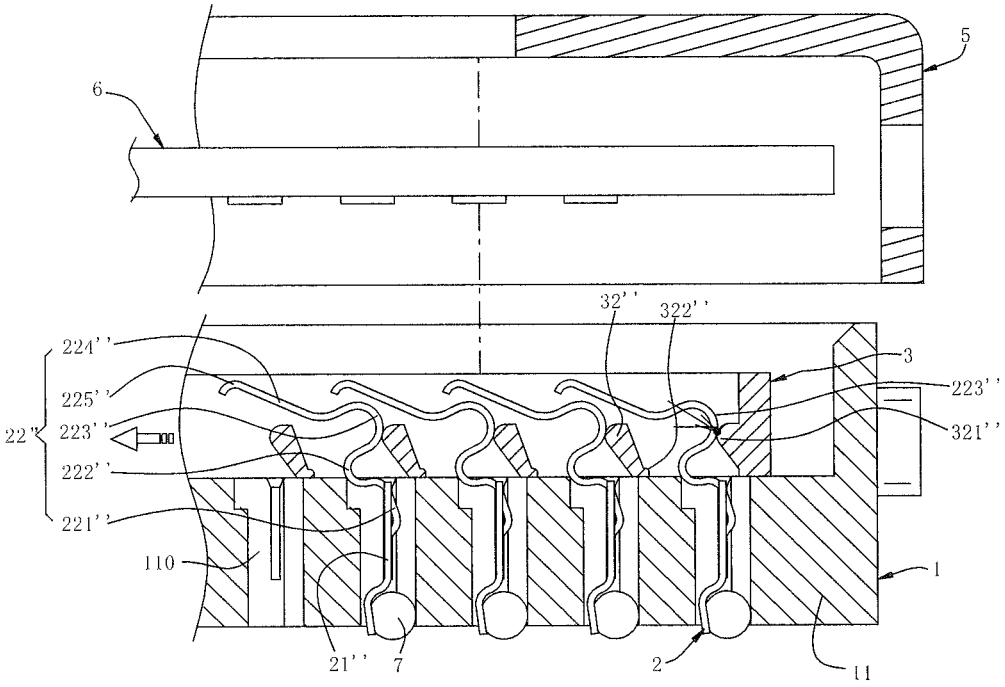
FIG. 9 is a schematic sectional view of the third embodiment of the electrical connector of the present invention when the cover slides along the first direction to the endpoint.

Referring now to FIG. 9, when the cover 3 slides along the first direction, the first pressed surface 321" of the extending portion 32" pushes the first stopping portion 223" of the terminal 2, so that the arm portion 22" deflects leftward and downward by taking a position where the arm portion 22" and the base 21" are connected as a fulcrum. As the center of circle corresponding to the first pressed surface 321" is located below the center of circle corresponding to the first stopping portion 223", the force produced by the first pressed surface 321" on the first stopping portion 223" is always upward, and the counterforce produced by the first stopping portion 223" on the first pressed surface 321" is always downward, so that the first stopping portion 223" can limit upward displacement of the first pressed surface 321", thereby limiting upward warping of the cover 3.

Alternatively, in order to enable the first stopping portion 223" to produce a downward force on the first pressed surface 321" when the cover 3 slides along the first direction, the first pressed surface 321" and the first stopping portion 223" may not both be arc-shaped, for example, the first pressed surface 321" is arc-shaped, and the first stopping portion 223" is a chamfer, and when the cover 3 slides along the first direction, the contact point between the first stopping portion 223" and the first pressed surface 321" is located above the center of circle corresponding to the first pressed surface 321", or when the cover 3 slides along the first direction, the first pressed surface 321" is a chamfer inclined rightward, and the first stopping portion 223" is also a chamfer inclined rightward.

Figure 10:
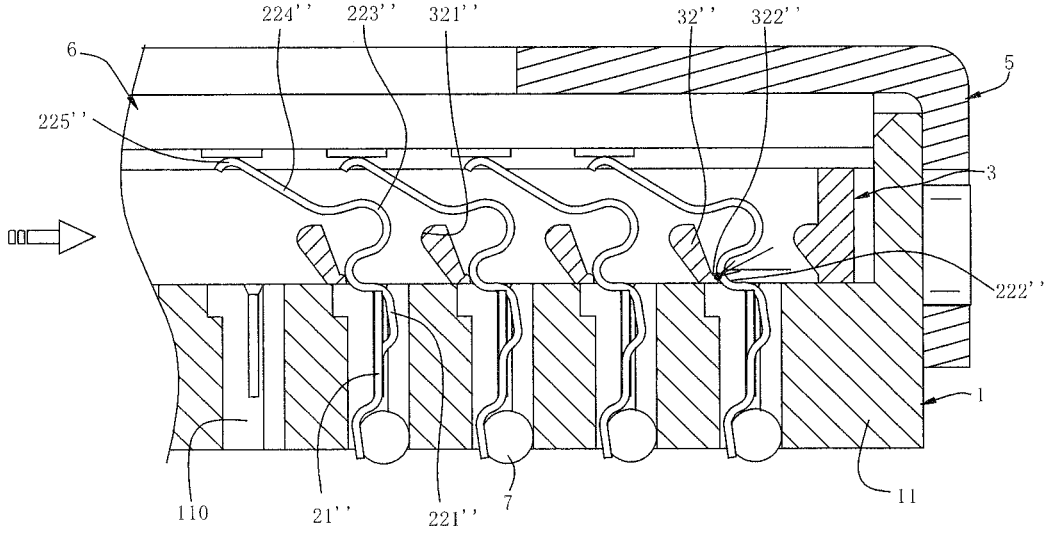
FIG. 10 is a schematic sectional view of the third embodiment of the electrical connector of the present invention when the cover slides along the direction opposite to the first direction to the endpoint.

Referring now to FIG. 10, when the cover 3 slides along the second direction, the second pressed surface 322" of the extending portion 32" pushes the second stopping portion 222" of the terminal 2. As the center of circle corresponding to the second pressed surface 322" is located below the center of circle corresponding to the second stopping portion 222", the second pressed surface 322" produces an upward force on the second stopping portion 222", and the second stopping portion 222" produces a downward counterforce on the second pressed surface 322", so that the second stopping portion 222" can limit upward displacement of the second pressed surface 322", thereby limiting upward warping of the cover 3. In addition, the second pressed surface 322" of the cover 3 pushes the second stopping portion 222" of the terminal 2, so that the contact portion 225" urges against the chip module 6 upward, thereby achieving good contact between the terminal 2 and the chip module 6.

Alternatively, the limitation of upward warping of the cover by fitting of the stopping portion of the terminal to the pressed surface of the cover is not limited to the above three embodiments, and the stopping portion and the pressed surface of the present invention may also be of other structures. For example, the stopping portion protrudes from one side of the arm portion, the cover has a groove corresponding to the stopping portion, and a lower surface of the groove forms the pressed surface. Or else, the extending portion is recessed downward to form a recessed portion, the cover has a protruding portion located in the recessed portion, a top surface of the recessed portion forms the stopping portion, and a top surface of the protruding portion forms the pressed surface. Alternatively, one of ordinary skill in the art can derive other structures based on the above, which will not be enumerated one by one herein.

In the above three embodiments, the cover is used to push the terminals, however, the present invention is not limited thereto. For example, in other embodiments, a pushing member may be further connected to the cover, so as to push the terminals through sliding of the pushing member, or the terminals may also be used to push the cover. In addition, when the cover slides, the terminals may also remain still. Therefore, the present invention is not limited to the TLGA electrical connector, and may also be other types of electrical connectors such as a Land Grid Array (LGA) electrical connector and a Pin Grid Array (PGA) electrical connector.

The embodiments according to the present invention, among other things, have the following beneficial effects.

1. When the cover slides along the first direction relative to the body, as the stopping portion of the terminal limits upward displacement of the pressed surface of the cover, and further limits upward warping of the cover, the cover can complete the task of pushing the terminal, so as to avoid the situation that the terminal cannot protrude out of the upper surface of the cover due to excessive upward warping of the cover when the cover slides along the direction opposite to the first direction, thereby ensuring good contact between the terminal and the chip module.

2. When the chip module is placed, as the contact portion is located below the upper surface of the cover, an operator can mount the chip module to the cover of the electrical connector easily.

3. During transportation of the electrical connector, as the contact portion is located below the upper surface of the cover, the terminals can be prevented from being damaged due to an external impact.

4. In the first embodiment and the second embodiment, when the cover slides along the direction opposite to the first direction relative to the body, the arm portion of the terminal springs upward due to elasticity thereof, so that the contact portion moves upward. Therefore, the contact portion urges against the chip module upward and produces an upward force on the chip module, so as to ensure a sufficient force between the contact portion and the chip module, thereby achieving good electrical connection between the terminal and the chip module.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

(a) a body, having a plurality of receiving slots;

(b) a plurality of terminals, respectively received in the receiving slots, each terminal having a stopping portion; and (c) a cover, slideably covered on the body, and having a plurality of pressed surfaces respectively corresponding to the stopping portions, wherein when the cover slides along a first direction relative to the body, the stopping portion limits upward displacement of the pressed surface, wherein the cover has a plurality of pushing surfaces, and when the cover slides along the first direction, the pushing surface pushes the terminal to shift along the first direction, and the terminal produces an upward force on the pushing surface; and wherein the cover has a plurality of extending portions, and the pressed surface and the pushing surface are two different surfaces of the extending portion.

2. The electrical connector according to claim 1, wherein the stopping portion is located right above the pressed surface.

3. The electrical connector according to claim 1, wherein the stopping portion is located right above the pressed surface.

4. The electrical connector according to claim 1, wherein when the cover slides along the first direction, the pressed surface pushes the stopping portion to shift toward the first direction, and the stopping portion produces a downward force on the pressed surface.

5. An electrical connector, for electrically connecting a mating element, comprising:

(a) a body, having a plurality of receiving slots;

(b) a plurality of terminals, respectively correspondingly accommodated in the receiving slots, each terminal having a stopping portion and a contact portion; and (c) a cover, slideably covered on the body, and having a plurality of pressed surfaces respectively corresponding to the stopping portions, wherein when the cover is at a starting position, the contact portion is higher than an upper surface of the cover; and wherein the cover first slides along a first direction relative to the body, during which process the cover pushes the terminal so that the contact portion shifts downward, and the stopping portion limits upward displacement of the pressed surface, and then the cover slides along a direction opposite to the first direction, so that the contact portion shifts upward and urges against the mating element.

6. The electrical connector according to claim 5, wherein when the cover slides on an upper surface of the body along the first direction to an endpoint, the contact portion shifts downward to be below the upper surface of the cover; and when the cover slides along the direction opposite to the first direction, the contact portion protrudes out of the upper surface of the cover.

7. The electrical connector according to claim 5, wherein when the cover slides along the direction opposite to the first direction, the terminal is not pushed by an external force, and only springs upward due to elasticity thereof, so that the contact portion shifts upward to push the mating element to a predetermined height.

8. The electrical connector according to claim 5, wherein the cover has a plurality of pushing surfaces, and when the cover slides on an upper surface of the body along the first direction, the pushing surface pushes the terminal to shift downward, and the terminal produces an upward force on the pushing surface.

9. The electrical connector according to claim 8, wherein the cover has a plurality of extending portions, and the pressed surface and the pushing surface are two different surfaces of the extending portion.

10. The electrical connector according to claim 9, wherein the stopping portion is located right above the pressed surface.

11. The electrical connector according to claim 5, wherein the stopping portion is located right above the pressed surface.

12. The electrical connector according to claim 5, wherein when the cover slides along the first direction, the pressed surface pushes the stopping portion to shift toward the first direction, and the stopping portion produces a downward force on the pressed surface.

* * * * *